US005150097A

United States Patent [19]

Sakaguchi

[11] Patent Number: 5,150,097

[45] Date of Patent: Sep. 22, 1992

[54] MOTOR DRIVEN BELL STRIKING MECHANISM

[75] Inventor: Mitsuo Sakaguchi, Tokyo, Japan

[73] Assignee: Kobishi Electric Co., Ltd., Tokyo, Japan

[21] Appl. No.: 399,155

[22] Filed: Aug. 28, 1989

[51] Int. Cl.[5] ..... G10K 1/064

[52] U.S. Cl. ..... 340/396; 340/392

[58] Field of Search ..... 340/396, 392, 400, 402; 116/152, 154, 155, 165, 164

[56] References Cited

U.S. PATENT DOCUMENTS

| | | | |
|---|---|---|---|
| 4,183,018 | 1/1980 | Sakaguchi | 340/396 |
| 4,306,227 | 12/1981 | Ishii | 340/396 |
| 4,329,680 | 5/1982 | Ishii | 340/396 |
| 4,970,490 | 11/1990 | Andrews | 340/396 |

FOREIGN PATENT DOCUMENTS

| | | | |
|---|---|---|---|
| 2119149 | 11/1983 | United Kingdom | 116/154 |

*Primary Examiner*—Jin F. Ng
*Assistant Examiner*—Brian R. Tumm
*Attorney, Agent, or Firm*—Iandiorio & Dingman

[57] ABSTRACT

The present invention relates to a motor driven type bell striking device to be employed in electric bells. The device incorporates a cam coupled with the rotating drive shaft of an electric motor, the cam translating the rotary motion of the motor to an oscillating action which serves to impel a piston, the piston then impelling a striking member which is coupled with the base or frame of the bell by a spring. In one preferred embodiment, the previously mentioned spring is a coil spring which wraps around the piston. In a second preferred embodiment, a leaf spring is employed. In both embodiments, the energy of the moving piston is translated into inertia in the striking member. Because the striking member is relatively free floating in the direction in which it moves, a sharp, clear ring sound is made possible with each impact of the striking member.

5 Claims, 3 Drawing Sheets

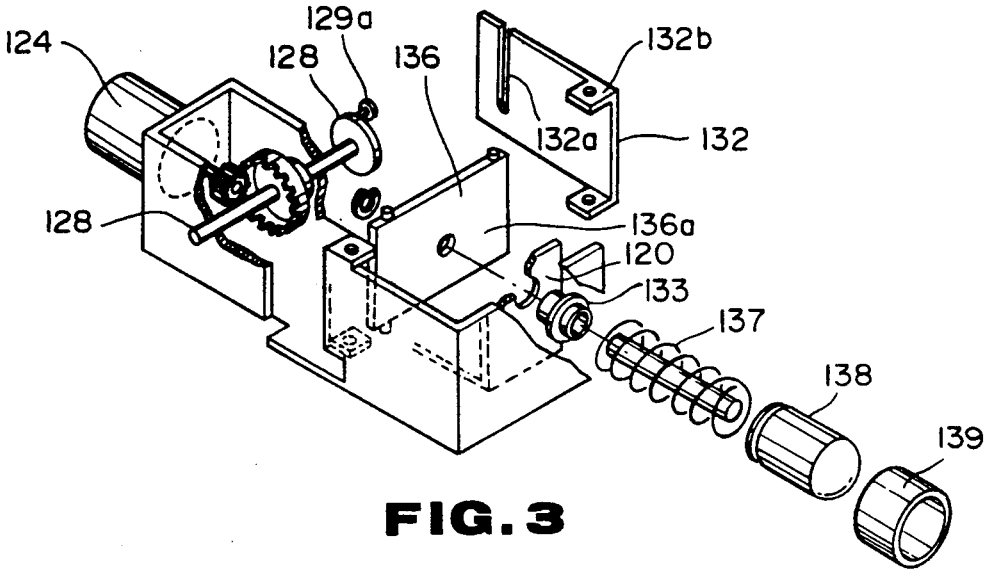
FIG. 3
FIG. 9
(PRIOR ART)
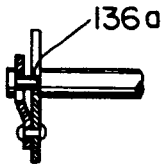
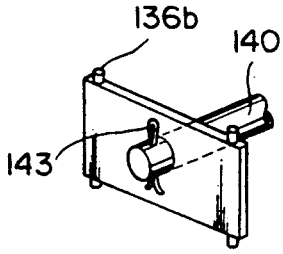
FIG. 10
(PRIOR ART)
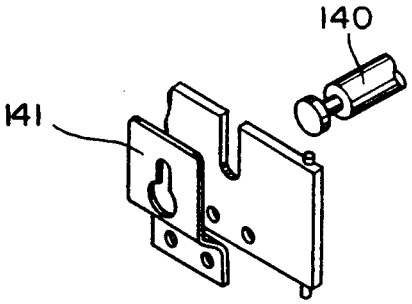
FIG. 4
(PRIOR ART)
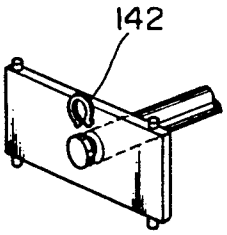
FIG. 5
(PRIOR ART)

MOTOR DRIVEN BELL STRIKING MECHANISM

BACKGROUND OF THE INVENTION

The present invention relates to a motor driven type bell striking device to be employed in electric bells, the device incorporating a cam coupled with the rotating drive shaft of an electric motor. The cam serves to translate the rotary motion of the motor to an oscillating action which then impels a piston, the piston then impelling a striking member which is coupled with the base or frame of the bell by a spring.

In a conventional motor driven bell of this type (Sakaguchi, U.S. Pat. No. 4,183,018) as shown in FIGS. 7 and 8, an electric motor 1 is coupled with a cam 2 which then is coupled with a hammer supporting plate 3 which is pivotably mounted on frame 5. By this mechanism, the rotary motion of the motor 1 is converted into an oscillatory motion of hammer supporting plate 3 approximately perpendicular to the striking action of hammer head 6*a*. The aforementioned hammer supporting plate 3 is coupled with hammer 6 by two springs, leading spring 7 and following spring 8. A bushing 10 which surrounds the shaft 6*b* of hammer 6 intervenes between leading spring 7 and following spring 8 and between their connection with hammer supporting plate 3. Leading spring 7 extends distally along and surrounding hammer shaft 6*b*, attaching to hammer head 6*a*. Following spring 8 extends proximally along and surrounding hammer shaft 6*b*, attaching to the innermost end of hammer shaft 6*b* via a washer 9.

Thus the vibrating motion of hammer supporting plate 3, and accordingly bushing 10 is transmitted to hammer 6 by leading spring 7 and following spring 8, thereby causing hammer head 6*a* to strike gong 11 repeatedly, thus producing a ringing sound. The hammer 6 is stabilized both proximally by bushing 10 and distally through a circular opening 12 in frame 5, thereby limiting its motion to one dimension. But a device of this construction has the following shortcomings:

(a) As it oscillates, hammer 6 must pass through both bushing 10 and the opening 12 in frame 5. Thus friction, hence damping of the transmitted vibrational energy occurs. Sound output is thereby diminished, loss of energy and increased wear occurs.

(b) The implementation of hammer supporting plate 3 requires increased moving parts, hence increased potential for wear, malfunction, and frictional energy loss.

In light of the above described shortcomings, the inventors of the present invention have striven to develop an improved bell striking mechanism.

SUMMARY OF THE INVENTION

Accordingly, it is an object of the present invention to provide an improved motor driven bell striking mechanism which in conjunction with a gong or similar type of sound generating member can generate a high quality ringing sound. A second object is to provide a dependable motor driven bell striking mechanism with a long service life. A third object is to provide a motor driven bell striking mechanism which efficiently utilizes motor output.

In an aspect of the present invention there is provided a motor actuated bell comprising: (a) a sound generating member; (b) a motor attached to the sound generating member, the motor having a rotatable drive shaft; (c) a push rod supported from the sound generating member so as to be movable in one dimension; (d) a cam means connecting the rotatable drive shaft to the push rod and converting a rotational movement of the drive shaft to a reciprocal movement of the push rod over a predetermined range; (e) a striking member supported from the sound generating member by an elastic means, the striking member being positioned to be out of contact with the sound generating member while the motor is not activated, the striking member at least momentarily being in contact with the push rod whereby receiving an urging force, separating from the push rod thereafter, and thereby afterwards momentarily striking the sound generating member for generating a sound therefrom while the motor is being activated.

The novel features characteristic of the present invention are set forth in the appended claims. The present invention, however, will be best understood by perusal of the following detailed description of the preferred embodiments with reference to the drawings.

BRIEF DESCRIPTION OF THE DRAWINGS

FIG. 3 is an exploded perspective view of the first embodiment of the present invention of which the plan view is shown in FIG. 1.

FIG. 4 is a detailed view of an example of the first embodiment of the present invention of which the plan view is shown in FIG. 1. In this example, the piston is fixed to the piston plate using a stopper plate.

FIG. 5 is a detailed view of an example of the first embodiment of the present invention of which the plan view is shown in FIG. 1. In this example, the piston is fixed to the piston plate using paired C-clips of which one is shown.

FIG. 7 is a plan view showing one example of a conventional motor driven bell.

FIG. 8 sectional side view of the conventional motor driven bell shown in FIG. 7.

FIG. 9 is a side view of the method of attachment of FIG. 4.

FIG. 10 is a detailed view of an example of the first embodiment of the present invention of which the plan view is shown in FIG. 1. In this example, the piston is fixed to the piston plate using a pin.

DETAILED DESCRIPTION OF THE PREFERRED EMBODIMENTS

Figure 1:
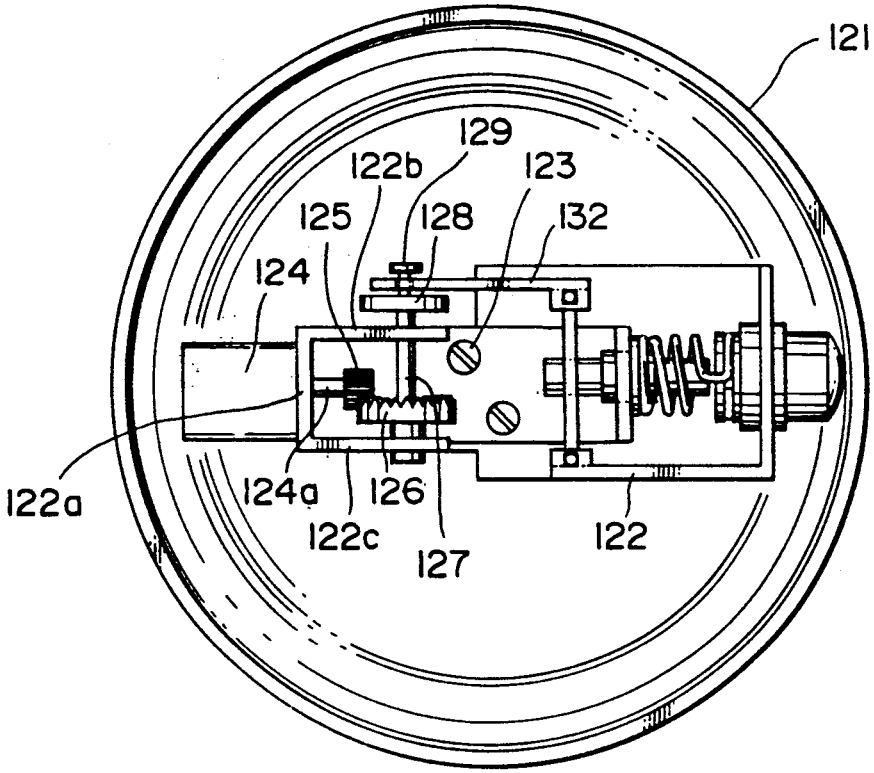
FIG. 1 is a plan view of the first embodiment of the present invention in which the mechanism uses a coil spring for the elastic means.
Figure 2:
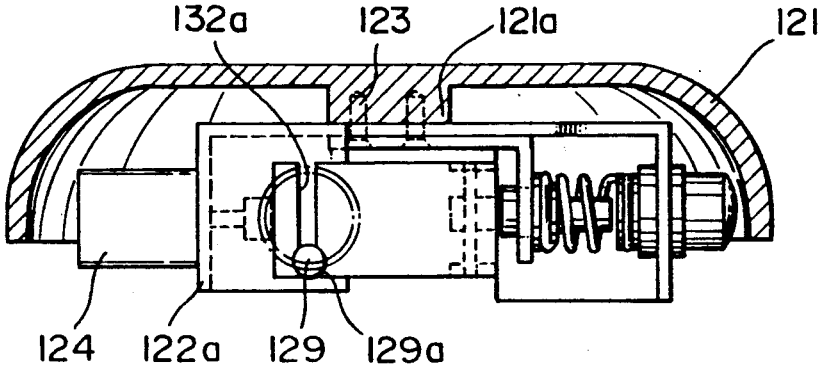
FIG. 2 is a sectional side view of the first embodiment of the present invention of which the plan view is shown in FIG. 1.

A first embodiment of the present invention is illustrated in FIGS. 1 to 5. A sound generating member 121 which is made of iron in the form of a cup or hemisphere has a mounting section 121*a* protruding the central portion of its inner wall. A frame 122 is secured to the mounting section with screws 123. Mounted on first side wall plate 122*a* of the frame 122 is an electric motor 124, on the rotary shaft 124*a* of which a pinion gear 125 is provided. A gear 126 fixedly mounted on a shaft 127 is engaged with the pinion gear 125. The shaft 127 is inserted into two opposing wall plates of frame 122, front wall plate 122*b* and rear wall plate 122*c*, and is thereby rotatably supported. A circular cam 128 is mounted on the rear end portion of the shaft 127. A cam pin 129 protrudes from the outermost side of cam 128 remote a predetermined distance from the center of cam 128. This cam pin 129 is adapted to make a circular motion with a predetermined radius as the shaft 127, and accordingly, the cam 128 are rotated. A rectangular cam plate 132 is provided with an elongated slot 132*a* formed in one end which engages with cam pin 129. A circular retaining piece 129*a* is provided on the end of cam pin 129 so that accidental disengagement of the cam plate 132 from can pin 129 does not occur. As cam pin 129 revolves in a circular path, the cam plate 132 oscillates. The end of cam plate 132 opposite slot 132*a* is equipped with elongated, hollow arc shaped projections 132*b* from its side in which piston plate 136 is pivotably engaged. Piston plate 136 has a hole 136*a* therethrough at a central portion thereof and a pair of projections 136*b* by which the piston plate 136 is pivotably attached to the projections 132*b* on the cam plate 132. A push rod 140 is attached to the piston plate 136 so that the axis of the push rod 140 is generally perpendicular to the plane of the piston plate 136. A proximate end of the push rod 140 is inserted in the through hole 136*a* of the piston plate and held in engagement therewith by means of either a pin 143 as shown in FIG. 10 or a C-clip 142 as shown in FIG. 5. The push rod 140 may alternatively be held in contact with the piston plate 136 by means of a stopper plate 141. Thus, piston plate 136 oscillates in a direction parallel with its longitudinal axis in conjunction with cam plate 132. Distal to hole 136*a*, push rod 140 passes slidingly through a bushing 133 which is in turn rigidly mounted on frame 122 by L-bracket 120 which is fixed to frame 122 by the previously described screw 123 which engage and mount sound generating member 121. A coil spring 137 is fixedly attached to the outward facing aspect of bushing 133 and coils around and extends distally along push rod 140. The distal end of coil spring 137 is fixedly connected with a striking member 138 and holds striking member 138 snugly against the end of push rod 140 when the bell is not activated. Striking member 138 passes slidingly through a bushing 139 which is fixedly mounted on second side wall plate 122*d*. In the following paragraph, the action of bell striking mechanism thus constructed will be described.

Activation of motor 124 results in a circular motion of cam pin 129 which is translated into oscillating motion of cam plate 132, piston plate 136, and hence push rod 140. During the half of its phase in which piston plate 136 moves towards the surrounding sound generating 121, the striking member 138 is propelled towards sound generating member 121 by the push rod 140. Thus, striking member 138 develops an inertia. As the motion of piston plate 136 slows and then reverses, striking member 138 separates from the end of push rod 140 and continues forward by virtue of its inertia. Because the proximal end of coil spring 137 is rigidly fixed to frame 122 rather than to piston plate 136 and is hence unmovable, and because striking member 138 is connected only to coil spring 137, only the elastic force of coil spring 137 opposes the forward inertia of striking member 138 until it impacts with sound generating member 121. Thus, highly efficient use is made of the received inertia and maximum sound output is possible. Upon impact, a ringing sound is generated and the striking member returns sharply in the opposite direction by virtue of its reversed inertia and the elastic recoil of spring 137. Accordingly, a sharp, clear ringing sound is generated by the very brief contact of striking member 138 with sound generating member 121. Finally, striking member comes to rest in its original position against the end of push rod 140 and shortly thereafter, the cycle begins again. In an alternative embodiment, a stopper member (not shown) may be attached to sound generating member 121 for limiting a movement of striking member 138 against the resilient force of coil spring 137 so that striking member 138 does not touch push rod 140 while motor 124 is not activated. As long as power is applied to motor 124, piston plate 136 continues to oscillate and the above described cycle is repeated over and over at high speed.

Figure 6:
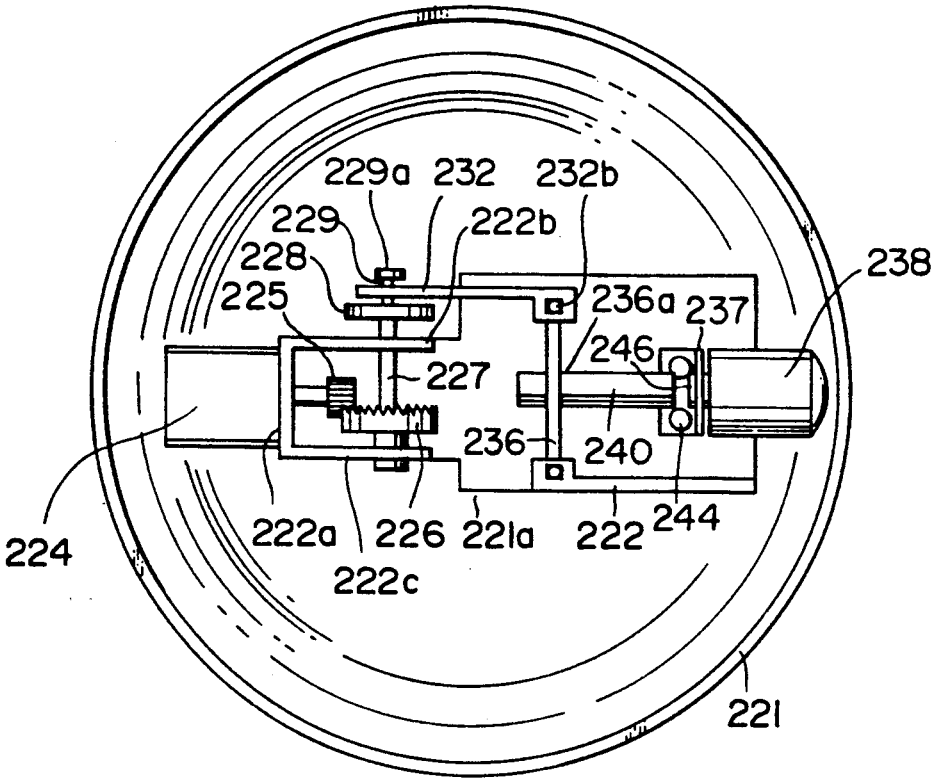
FIG. 6 is a plan view of the second embodiment of the present invention in which the mechanism uses a leaf spring for the elastic means.

A second embodiment of the present invention will now be described with reference to FIG. 6. A sound generating member 221 which is made of iron in the form of a cup or hemisphere has a mounting section 221*a* protruding from the central portion of its inner wall. A frame 222 is secured to the mounting section with bolts. Mounted on first side wall plate 222*a* of the frame 222 is an electric motor 224, on the rotary shaft 224*a* of which a pinion gear 225 is provided. A gear 226 fixedly mounted on a shaft 227 is engaged with the pinion gear 226. The shaft 227 is inserted into two opposing wall plates of frame 222, front wall plate 222*b* and rear wall plate 222*c*, and of thereby rotatably supported. A circular cam 228 is mounted on the rear end portion of the shaft 227. A cam pin 229 protrudes from the outermost side of cam 228 remote a predetermined distance from the center of cam 228. This cam pin 229 is adapted to make a circular motion with a predetermined radius as the shaft 227, and accordingly, the cam 228 are rotated. A rectangular cam plate 232 is provided with an elongated slot 232*a* formed in one end which engages with cam pin 229. A circular retaining piece 229*a* is provided on the end of cam pin 229 so that accidental disengagement of the cam plate 232 from cam pin 229 does not occur. As cam pin 229 revolves in a circular path, the cam plate 232 oscillates. The end of cam plate 232 opposite slot 232*a* is equipped with elongated, hollow, arc shaped projections 232*b* from its side in which piston plate 236 is pivotably engaged. Piston plate 236 has a hole 236*a* therethrough at a central portion thereof and a pair of projections 236*b* by which the piston plate 236 is pivotably attached to the projections 232*b* on the cam plate 232. A push rod 240 is attached to the piston plate 236 so that the axis of the push rod 240 is generally perpendicular to the plane of the piston plate 236. A proximate end of the push rod 240 is inserted into the through hole 236*a* of the piston plate and held in engagement therewith by means of either a pin 143 as shown in FIG. 10 or C-clips 142 as shown in FIG. 5. The push rod 240 may alternatively be held in contact with the piston plate 236 by means of a stopper plate 141 as in FIG. 4. Thus, piston plate 236 oscillates in a direction parallel with its longitudinal axis in conjunction with cam plate 232. A leaf spring 237 is fixedly attached to the inward facing aspect of a striking member 238. Stopper member 246, attached to sound generating member 221, holds striking member 238 distantly from the end of push rod 240 when the bell is not activated. In an alternative embodiment, stopper member 246 is not used and leaf spring 237 is of a suitable length and elasticity so as to retain striking member 238 against push rod 240 when motor 224 is not activated and to allow striking member 238 to separate from push rod 240 after a momentary application of an urging force by push rod 240. The opposite end of leaf spring 237 is in turn fixedly connected with frame 222 with two bolts 244. With this embodiment, attachment of the striking member 238 by leaf spring 237 leads to a slightly arcuate striking movement of striking member 238. Otherwise, the action of the above described second preferred embodiment is in every way analogous with that of the previously described first preferred embodiment except that the push rod 240 comes in contact with the striking member 238 when the electric motor 224 is activated to push or hit the striking member to ring the sound generating member 221.

Preferred embodiments as described in the preceding sections demonstrate the following features.

(a) The frequency of the striking action can be changed as desired by changing the speed of the motor or the gear ratio of the gear train.

(b) Variation in the length and elastic properties of the respective springs will affect ringing characteristics. A shorter or tenser spring causes a sharper ring due to decreased contact time with the sound generating member. If the spring is overly tense, sound output will be diminished.

What is claimed is:

1. A motor actuated bell comprising:

(a) a sound generating member;

(b) a motor attached to the sound generating member, the motor having a rotatable drive shaft;

(c) a push rod supported from the sound generating member so as to be movable in one dimension;

(d) a cam means connecting the rotatable drive shaft to the push rod and converting a rotational movement of the drive shaft to a reciprocal movement of the push rod over a predetermined range;

(e) elastic means attached to said sound generating member; and (f) a striking member supported from the sound generating member by said elastic means, the striking member being positioned to be out of contact with the sound generating member while the motor is not activated, the striking member at least momentarily being in contact with the push rod whereby receiving an urging force, separating from the push rod thereafter, and thereby afterwards momentarily striking the sound generating member for generating a sound therefrom while the motor is being activated.

2. A motor actuated bell according to claim 1 in which the elastic means is a leaf spring.

3. A motor actuated bell according to claim 2 wherein the leaf spring connects the striking member and the sound generating member, the leaf spring being of a suitable length and elasticity so as to retain said striking member against an end of the push rod when the motor is not activated and to allow the striking member to separate from the push rod after momentary application of an urging force by the push rod and thereby afterwards momentarily strike the sound generating member by which a sound is generated.

4. A motor actuated bell according to claim 2 wherein the leaf spring connects the striking member to the sound generating member and supports the striking member to be out of contact with the push rod while the motor is not activated.

5. A motor actuated bell according to claim 4 wherein a stopper member is attached to the sound generating member for limiting a movement of the striking member against a resilient force of the leaf spring so that the striking member does not touch the push rod while the motor is not activated.

* * * * *